US011672740B1

(12) United States Patent
Norman

(10) Patent No.: US 11,672,740 B1
(45) Date of Patent: Jun. 13, 2023

(54) BOTTLE-AFFIXED DOSE REMINDER DEVICE

(71) Applicant: Zachary Norman, Venice, CA (US)

(72) Inventor: Zachary Norman, Venice, CA (US)

( * ) Notice: Subject to any disclaimer, the term of this patent is extended or adjusted under 35 U.S.C. 154(b) by 20 days.

(21) Appl. No.: 17/351,127

(22) Filed: Jun. 17, 2021

Related U.S. Application Data

(60) Provisional application No. 63/041,006, filed on Jun. 18, 2020, provisional application No. 63/040,218, filed on Jun. 17, 2020.

(51) Int. Cl.

| | |
|---|---|
| ***G08B 1/08*** | (2006.01) |
| ***A61J 7/04*** | (2006.01) |
| ***G08B 21/24*** | (2006.01) |
| ***A61J 1/03*** | (2023.01) |

(52) U.S. Cl.
CPC ..... *A61J 7/0436* (2015.05); *A61J 1/03* (2013.01); *A61J 7/0418* (2015.05); *A61J 7/0481* (2013.01); *G08B 21/24* (2013.01)

(58) Field of Classification Search
CPC ..... A61J 7/0436; A61J 1/03; A61J 7/0418; A61J 7/0481; G08B 21/24
USPC ..... 340/539.1
See application file for complete search history.

(56) References Cited

U.S. PATENT DOCUMENTS

| | | | | |
|---|---|---|---|---|
| 5,271,353 | A * | 12/1993 | Besthorne | A61J 7/04 116/318 |
| 7,042,807 | B1 | 5/2006 | Breen | |
| 7,081,807 | B2 * | 7/2006 | Lai | G08B 21/24 368/110 |
| 7,554,434 | B1 | 6/2009 | Gifford et al. | |
| 8,666,543 | B2 | 3/2014 | MacVittie et al. | |
| 9,311,452 | B2 | 4/2016 | Dickie et al. | |
| 9,717,652 | B2 | 8/2017 | Geboers | |
| 9,934,698 | B2 * | 4/2018 | Horn | G09B 19/00 |
| 2010/0164716 | A1 | 7/2010 | Estevez et al. | |
| 2010/0270257 | A1 * | 10/2010 | Wachman | G06Q 10/10 215/228 |
| 2011/0060457 | A1 | 3/2011 | De Vrught et al. | |
| 2011/0227734 | A1 | 9/2011 | Ortenzi et al. | |
| 2015/0283036 | A1 | 10/2015 | Aggarwal et al. | |
| 2015/0360834 | A1 * | 12/2015 | Mikhail | B65D 51/248 340/384.5 |
| 2016/0120758 | A1 | 5/2016 | Pi et al. | |
| 2017/0236390 | A1 * | 8/2017 | Herschkowitz | A61B 5/7455 340/539.12 |

FOREIGN PATENT DOCUMENTS

| | | |
|---|---|---|
| EP | 2088984 | 8/2009 |
| JP | 5676755 | 2/2015 |
| WO | 31/50434 | 7/2001 |
| WO | 2011/094353 | 8/2011 |

* cited by examiner

*Primary Examiner* — Tai T Nguyen
(74) *Attorney, Agent, or Firm* — Pacifica IP

(57) ABSTRACT

A dose reminder device having a main body with electrical components held therein and a bottle-agnostic strap or detachable adapter for attaching the dose reminder device to bottles of varying shapes and sizes. The dose reminder device is registered and connected to a host server over a network via a programming application interface operating on a mobile device or a computer-based device.

12 Claims, 10 Drawing Sheets

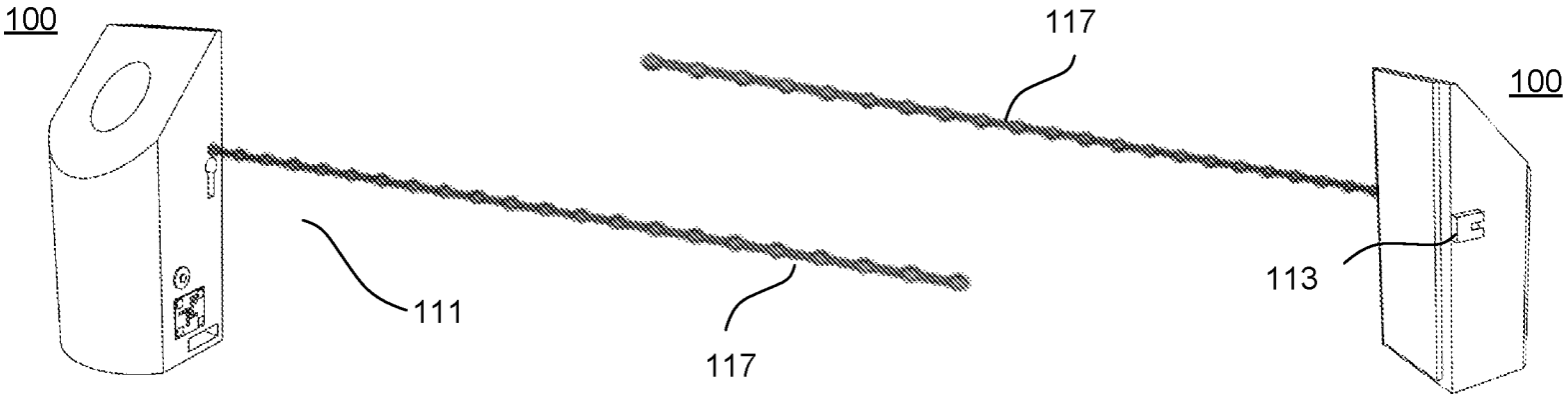
FIG. 2B
FIG. 2A
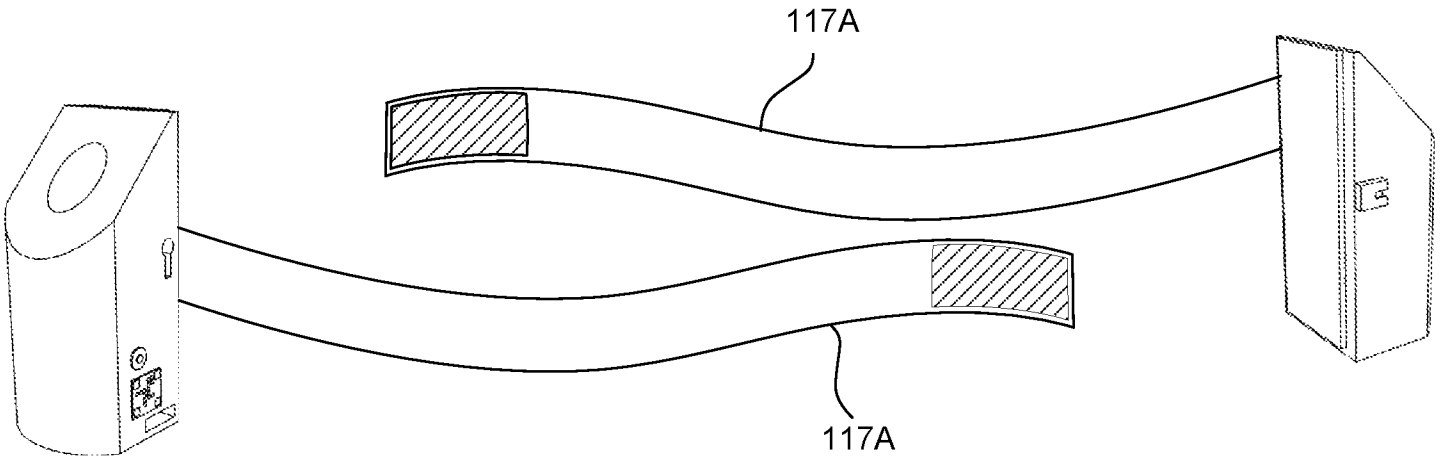
FIG. 2D
FIG. 2C

BOTTLE-AFFIXED DOSE REMINDER DEVICE

RELATED APPLICATIONS

This application claims the benefit of priority of U.S. Provisional Application Ser. No. 63/040,218, filed on Jun. 17, 2020, and U.S. Provisional Application Ser. No. 63/041,006, filed on Jun. 18, 2020, which is herein incorporated by reference to the present application.

FIELD OF THE DISCLOSURE

The present disclosure relates to a bottle-affixed dose reminder device. In particular, the bottle-affixed dose reminder device may include a dose reminder device having a main body with electrical components held therein and a bottle-agnostic strap or adapter for attaching the dose reminder device to bottles of varying shapes and sizes.

BACKGROUND

Medication bottles (also known as pill bottles) often come in different types of containers having various shapes and sizes. The most common pill bottles are cylindrically shaped and about 1 to 3 inches in height. Patients or users who are required to take medications are provided dosage amounts and daily frequency of how often they should take their medication based on their prescription provided by their doctor. Some pill reminder devices may include simple containers having individual compartments and markings indicating a day and time for each compartment. These pill reminder devices generally serve as a visual reminder for the user to take their required medication at the appropriate day and time as marked in each compartment in the container. In addition, the user must manually insert each pill into each compartment according to the dosage amounts and daily frequency indicated on their prescription. Though useful, having to manually separate, sort, and manage pills using this type of pill reminder device can be cumbersome and somewhat time consuming for the user.

Accordingly, there is a need for a smart dose reminder device that is simple to use, interactive, and made to easily to attach or adapt to any medication, pill or supplement bottle type of any shape or size without having to use a separate container to manually separate and store each pill into separate compartments in the container.

SUMMARY

The present disclosure relates to a dose reminder device that is designed to attach securely to pill bottles of various sizes. More specifically, the device reminds a user to take his/her medication by flashing a light and/or sounding an alarm at intervals set by the user or using information collected about the medication. The alarm is turned off when a user picks up the bottle and tilts the bottle to dispense a pill, vitamin, etc.

One advantage of the present disclosure is to provide a dose reminder device having a main body, an adjustable bottle-agnostic strap affixed to the main body, encompassing a medication bottle (or pill bottle), allowing the bottle-agnostic strap to accommodate and secure to medication bottles of different shapes and sizes; and electrical components housed within the main body for executing dose reminder programming codes and operating the dose reminder device. In addition, the electrical components may include at least a rotation sensor for detecting movement of the dose reminder device.

In one implementation, the bottle-agnostic strap may include a ball-chain type strap. In another implementation, the plurality of electrical components may include a microprocessor, a memory component, and input/output interface, a network device, and audio driver, an LED driver, a wireless communication device, and a battery. In yet another implementation, the wireless communication device may include a Wi-Fi device and or a Bluetooth device. In still yet another implementation, the microprocessor may execute one or more computer-executable programming code stored in said memory component. In yet another implementation, the dose reminder device is registered and connected to a host server over a network via a programming application interface operating on a mobile device or a computer-based device.

BRIEF DESCRIPTION OF THE DRAWINGS

A more complete understanding of the present disclosure may be obtained by reference to the detailed description when taken in conjunction with the accompanying drawings, in which like reference characters designate the same or similar parts throughout the several drawings.

FIG. 2A-FIG. 2D illustrate perspective views of the dose reminder device with a strap attached thereon, in accordance to an embodiment.

DETAILED DESCRIPTION

Figure 1A:
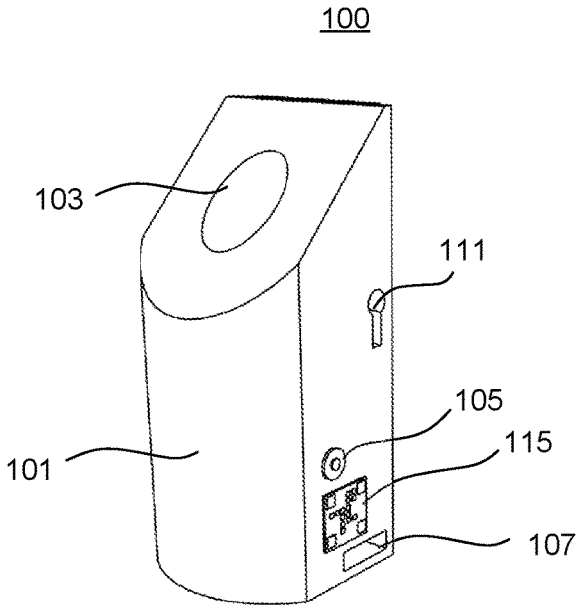
FIG. 1A-FIG. 1D illustrate multiple perspective views of a dose reminder device having a main body with electrical components held therein and strap fasteners applied to the main body, in accordance to an embodiment.
Figure 1B:
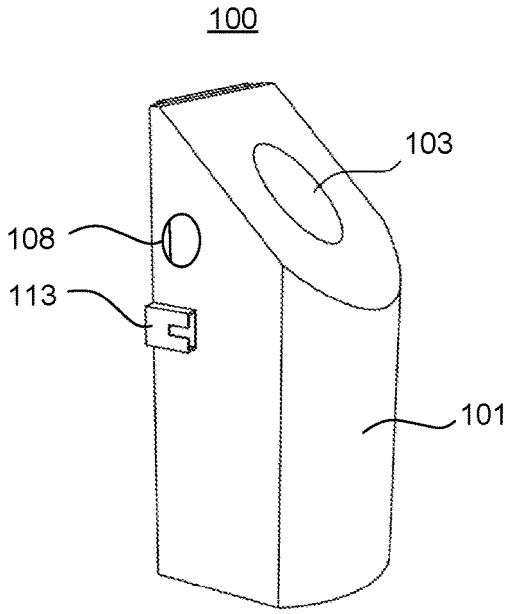
Figure 1C:
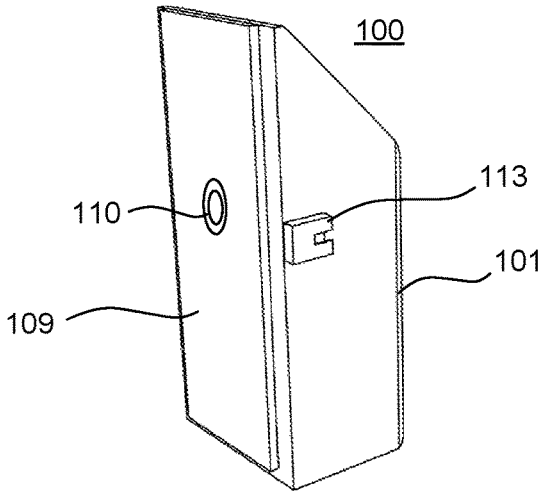
Figure 1D:
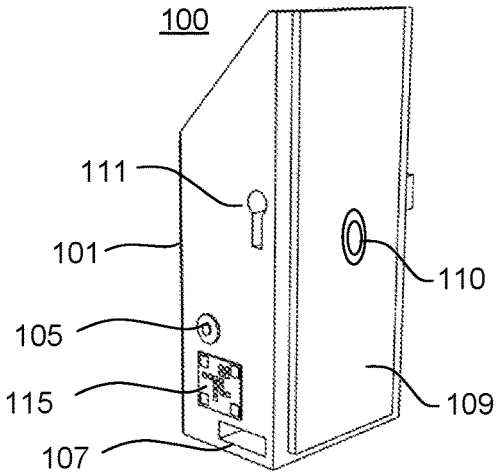

FIG. 1A-FIG. 1D illustrates multiple perspective views (i.e., front-right, front-left, back-right, and back-left, respectively) of a dose reminder device 100 generally having a main body 101 with electrical components held therein and strap fasteners applied to the main body 101, in accordance to an embodiment. For example, some these electrical components of the dose reminder device 100 may include a pill dose reminder light 103 disposed on a portion of the main body 101, a user interaction button 105 disposed on a side portion of the main body 101, and a charging port 107 also disposed on the side portion of the main body 101. The main body 101 of the dose reminder device 100 may also include a backing strip 109 (e.g., rubber non-slip grip or fastener) attached to a back portion of the main body 101, a first strap locking fastener 111 coupled the side portion of the main body 101, and a second strap locking fastener 113 coupled to another side portion of the main body 101. The first strap locking fastener 111 and the second strap locking fastener 113 may be a keyhole type fastener or box slot type fastener which allows tension adjustments to an adjustable strap (shown and describe in the next section). In addition, computer readable identification and reference indicia 115 may be applied to the main body 101 including, for example, QR Codes, barcodes, or optical character recognition (OCR) symbols. In one aspect, the main body 101 of the dose reminder device 100 may also include a battery cover 108 which provides access to an internal battery (not shown). In another aspect, the main body 101 of the dose reminder device 100 may include a bottle depressible button or bottle sensor 110 for detecting when a bottle (not shown) is attached to the dose reminder device 100.

FIG. 2A-FIG. 2B illustrate perspective views (i.e., front-right and back-right, respectively) of the dose reminder device 100 with a strap 117 attached thereon, in accordance to an embodiment. In one implementation, the strap 117 can lock into the first strap locking fastener 111 (i.e., keyhole slot) in the side of the main body 101 and can be secured to the second strap locking fastener 113 (i.e., box slot type fastener). In another implementation, the strap 117 can lock into the first strap locking fastener 111 via the keyhole in the side of the main body 101 and can be secured to a battery compartment door when locked closed (not shown in FIG. 1). In operation, the strap 117 may be adjustable to accommodate different bottle sizes and can be of a ball-chain type strap, for example.

FIG. 2C-FIG. 2D illustrate perspective views (i.e., front-right and back-right, respectively) of the dose reminder device 100 with an adjustable Velcro strap 117A attached thereon, in accordance to an embodiment. Velcro strap 117A can wrap around different bottles and attach to itself.

Figure 3B:
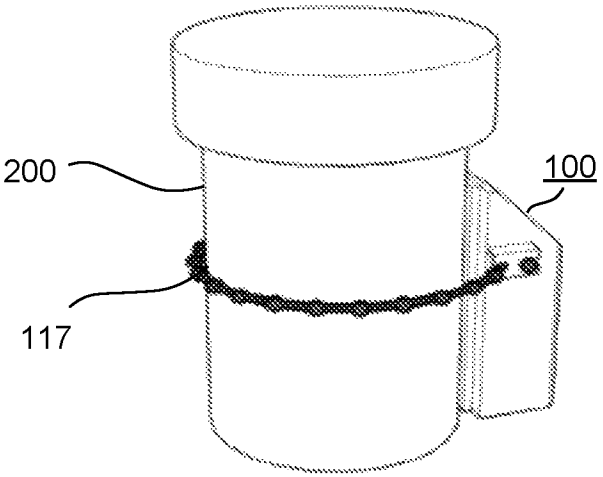
FIG. 3A-FIG. 3B illustrate perspective views of the dose reminder device attached to a bottle via strap, in accordance to an embodiment.
Figure 3A:
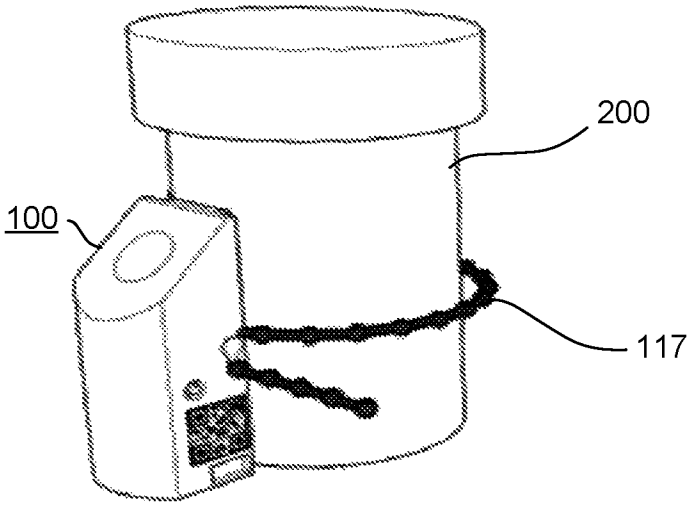

FIG. 3A-FIG. 3B illustrate perspective views (i.e., front-right and back-right, respectively) of the dose reminder device 100 attached to a bottle 200 via strap 117, in accordance to an embodiment. The strap 117 may be made of rubber or non-slip materials such that the dose reminder device 100 attaches securely and not easily fall off the bottle 200 or any other pill containers of different shapes. In other words, the strap 117 is bottle-agnostic with respect to the shape and/or size of the bottle 200, allowing it to be secured to any types of bottles. In operation, tension of the strap 117 may be adjusted via the keyhole slot 111 by pulling the strap 117 through an upper hole of the keyhole slot 111 and then securing and locking it in place into a lower hole of smaller diameter using the ball-chain type strap.

Figure 4:
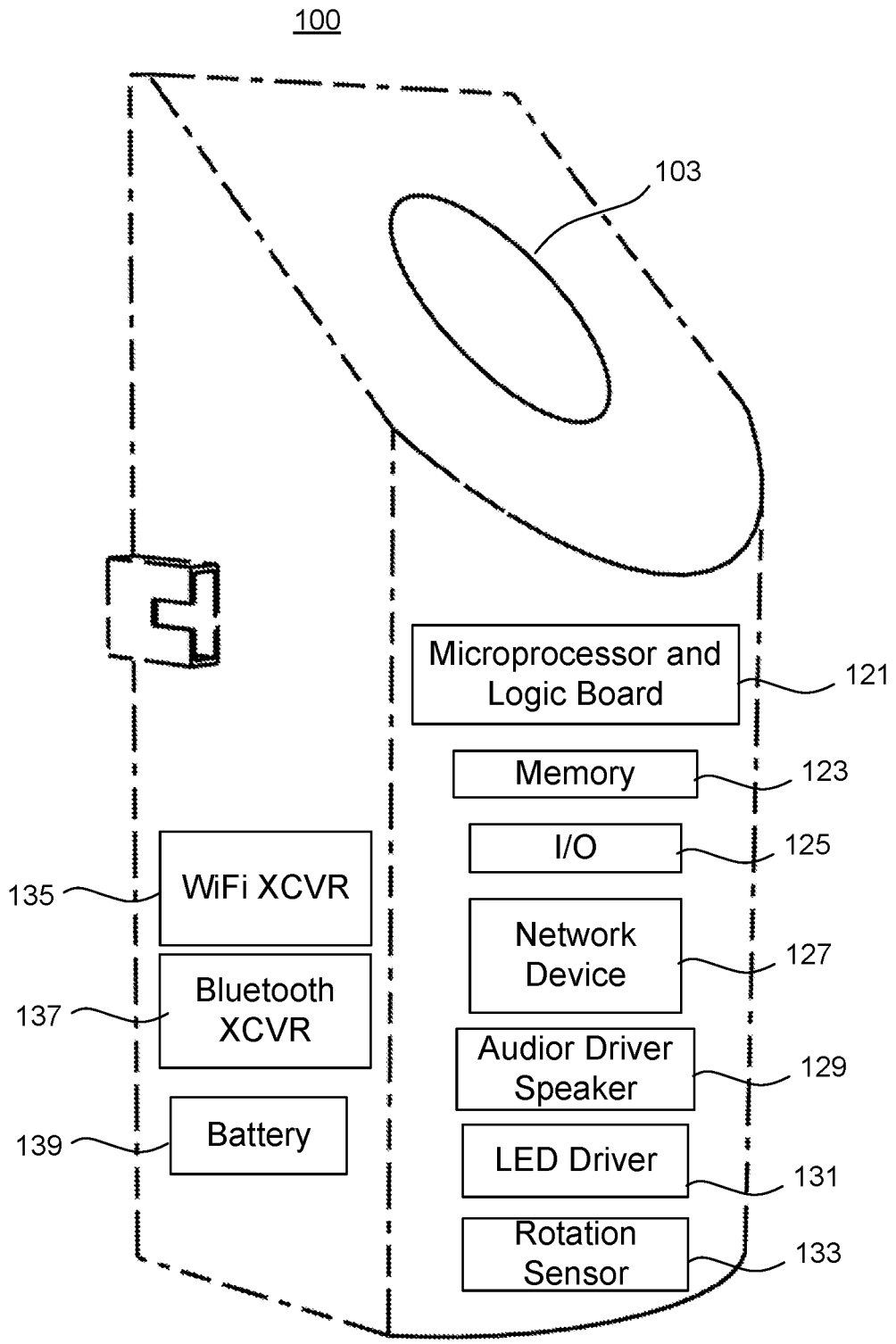
FIG. 4 illustrate internal electrical and system components contained inside the main body for controlling and executing the operational functions of the dose reminder device, in accordance to an embodiment.

FIG. 4 illustrates internal electrical and system components contained inside the main body 101 for controlling and executing the operational functions of the dose reminder device 100, in accordance to an embodiment. For example, the electrical components held within the main body 101 of the dose reminder device 100 can include a microprocessor and logic board 121, system memory 123, an input/output I/O controller 125, a network interface device 127, an audio alarm driver and speaker 129, and LED driver 131 for controlling the reminder light 103, an rotation sensor 133 for detecting movement, tilt, or rotation of the dose reminder device 100, a Wi-Fi transceiver 135, a Bluetooth transceiver 137, and an rechargeable battery 139 coupled to charging port 107. The dose reminder device 100 may also include an electrical cord (not shown) for charging the rechargeable battery 139 via the charging port 107 which can include a USB type charging ports including, for example, USB-A, USB-B, USB-B Mini, USB-B Micro, and USB-C. Each device has a unique QR code on the side. The device can be either waterproof or highly water resistant.

In practice, when a user initially receives the dose reminder device 100, the user opens the battery cover 108 and removes a thin plastic battery isolator to allow for the flow of the battery current to provide DC power to the dose reminder device 100. Next, the user affixes the strap 117 through of the appropriate length into the dose reminder device 100, locking it in place with the battery door 108. The strap 117 can also be attached at the second strap locking fastener 113. Next, the user then charges the rechargeable battery 139 via the charging port 107 with a cable (not shown).

In one implementation, the dose reminder device 100 may be configured to detect any internal rotation or movement of the pill bottle 200 when attached to the dose reminder device 100 via the rotation sensor 133. In one example, the user may cancel a given dose alarm event via the rotation sensor 133 of the dose reminder device 100 by rotating, tilting, or moving the attached pill bottle 200. In another example, the rotation sensor 133 can detect and feedback to the microprocessor 121 whether the user only picks up the pill bottle 200, rotates it (as one might do to remove a pill) and places it back down the counter to cancel any given dose alarm event. The rotation sensor 133 can be an accelerometer, inclinometer or other sensor that measures movement, rotation, and/or tilt. In yet another example, the dose reminder device 100 may use the button interaction button 105 or a separate alarm cancellation push-button (not shown) to cancel the alarm cycle, instead of using the rotation function. The alarm cancellation push-button can be applied as a simple alternative to the internal automatic rotation function or can be used as the main alarm cancelation method where the dose reminder device 100 does not include the rotation sensor 133 with no internal accelerometer. This alarm cancellation push-button can have protective ridges to prevent accidental disarms while in travel. If the dose reminder device 100 has both rotation sensing and the push-button cancellation capability, then the user can select to use both, or one or the other as a preference in the mobile app settings. Optionally, the interaction button 105 or the push-button of the dose reminder device 100 can be used with a multiple click interface. For example, a single press of the button will cancel the alarm. Two taps within some amount to time will start the Bluetooth function. Three taps will test connection. Four taps perform a device reboot, etc.

In another implementation, the reminder light 103 of the dose reminder device 100 flashes on-and-off to remind the user to take their medicine during a dose alarm event. The dose reminder device 100 may also have an audio alarm controlled by the audio driver and speaker 129 to remind the user audibly to take his/her medicine. This audio alarm can be a simple beeping sound, song, or may be a recorded voice. The intensity of the audio alarm may also increase in volume over time during a dose alarm event, agitating and reminding the user to take their take his/her medicine. In yet another implementation, the user secures the dose reminder device 100 on the bottle 200 using the strap 117 and keyhole slot 111. When the audible and/or visible alarm goes off, the user tilts the bottle along with the dose reminder device 100 to take the pill, thereby resetting the alarm.

In another embodiment, the dose reminder device 100 can utilize the Wi-Fi transceiver 135 to connect directly to a host server via a Wi-Fi connection for communication status information and updating operating code of the dose reminder device 100. In addition, the dose reminder device 100 may include two types of wireless communication models: one with both the Wi-Fi 135 and the Bluetooth interfaces 137 and another with only Bluetooth 137. In this way, the user can have multiple add-on Bluetooth-only features, which requires fewer components to manufacture reducing overall cost to build. In operation, the Bluetooth connection may send data to the host Wi-Fi and Bluetooth unit that is responsible for sending data to a host server (e.g., cloud). In yet another embodiment, the dose reminder device 100 is configured to communicate directly with a mobile device and not the host, sending data via Bluetooth to the mobile phone, not the cloud. The dose reminder device 100 may also have only Wi-Fi for communicating data over a network as described in next section. In this embodiment, the user may connect the dose reminder device 100 to their mobile device, computer or other connected device via a USB cable for the purpose of configuring the dose reminder device 100.

Referring again to the system components of the dose reminder device 100 in FIG. 4, the microprocessor 123 may also execute computer-executable programming code stored in a memory device 123 as well as retrieving data stored in a non-transitory computer readable medium. Some examples of the microprocessor 123 may include a central processing unit (CPU), an application-specific integrated circuit (ASIC), a field-programmable gate array (FPGA), or any other computer processing device, including single-core microprocessors, dual-core microprocessors, and or multi-core microprocessors. The non-transitory computer-readable medium may store mobile app data, programming code data, firmware data, application device settings, and user settings for operating the dose reminder device 100. The mobile app data and programming code data may include machine language interpreted data that is executable on the microprocessor 123. Some examples of mobile app data and programming code may include high level programming languages such as Perl, Java, JavaScript, C, C++, Python, and HTML.

Figure 5B:
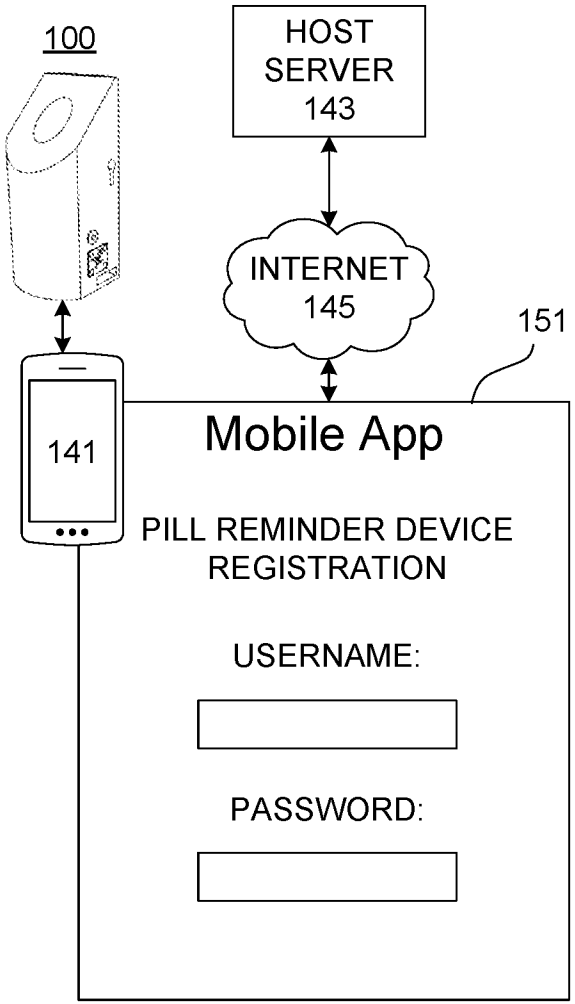
FIG. 5A-FIG. 5B illustrate user programming application interfaces for a computer-based device and mobile device, respectively, for registering the user of the dose reminder device to a dose reminder device host server over a network.
Figure 5A:
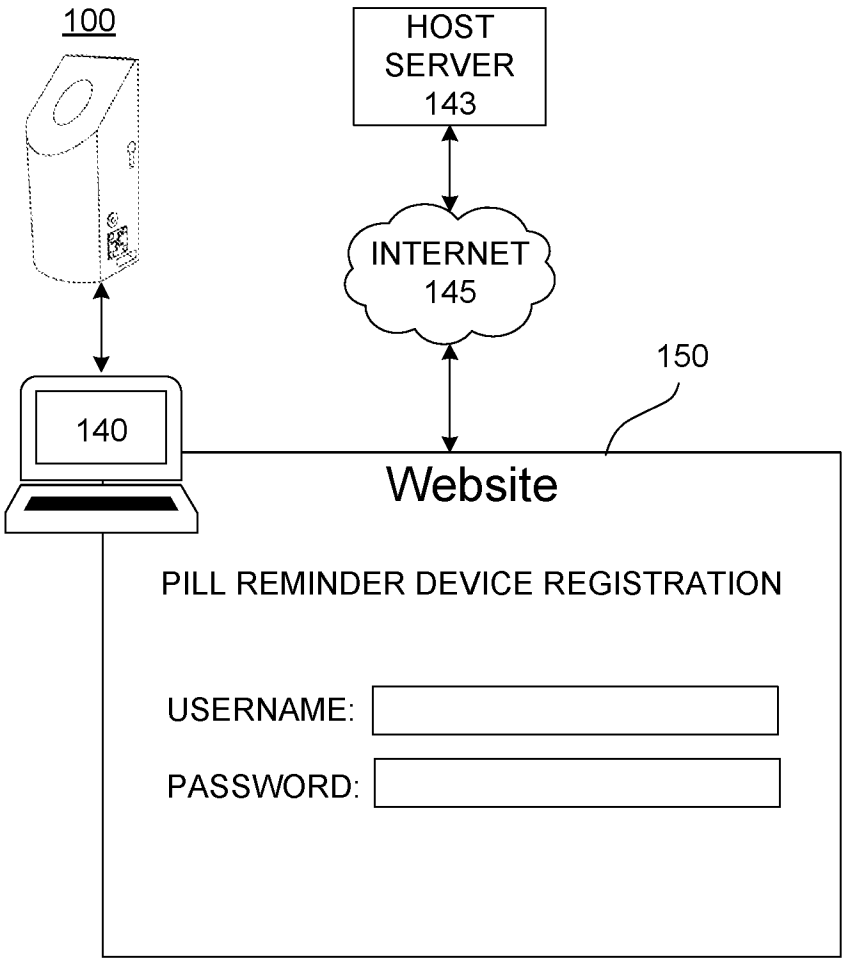

FIG. 5A and FIG. 5B illustrate programming application interfaces for a computer-based device 140 and mobile device 141, respectively, for registering the dose reminder device 100 to a reminder device host server 143 over a network 145 (e.g., Internet 145) via a wired or wireless connection, in accordance to an embodiment. The programming application interfaces can either be used in the form of a browser client application (aka "a web page" 150) operating on the computer-based device 140 or in the form of a native application (aka "a mobile app" 151) operating in the mobile device 141 such as smartphones, tablets, or personal digital assistant devices. The computer-based device 140 may include, for example, a display monitor, input devices (e.g., keyboard, mouse, optical scanners, camera, and microphone), serial data ports, network interface devices, and speakers. The mobile device 141 may include a touchscreen display, camera, microphone, accelerometer, wireless network device, serial data ports, and speakers. Prior to setting up and registering the dose reminder device 100, the user may download the mobile app 151 to their preferred mobile device to configure the dose reminder device 100. Through the mobile app 151, the user registers for an account with a cloud-based service over the Internet 145 using and username and a password. Other personal data useful to the service may also be collected. Account registration may or may not require a payment. If registration does require payment, the user is directed into a subscription payment user interface. The subscription may include a first for the year of service.

Figure 6:
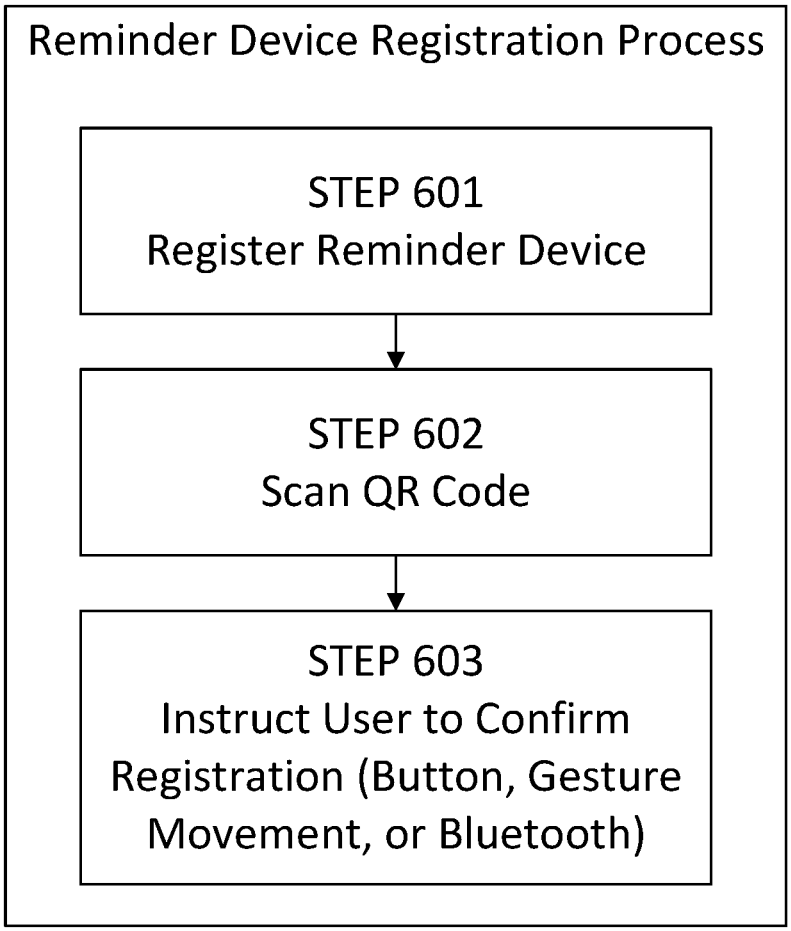
FIG. 6 illustrates a flowchart for registering the dose reminder device to the dose reminder device host server, in accordance to an embodiment.

FIG. 6 illustrates a flowchart for registering the dose reminder device 100 to the dose reminder device host server 143 using the computer-based device 140 and the mobile device 141, in accordance to an embodiment. Once the user is registered with the host server 143 via the website 150 or mobile app 151, the companion application directs the user to scan the dose reminder device 100 (Step 601). For the mobile app 151, the camera of the mobile device is used for scanning purposes, prompting the user to point the camera at the unique QR code 115 on the dose reminder device 100 to scan, read, and input information of the dose reminder device 100 into the mobile app 151 (Step 602). Once the dose reminder device 100 is registered by the mobile device 141, the mobile app 151 attaches the scanned reminder device 100 to the user's account and then instructs the user to press the interaction button 105 on the side of the dose reminder device 100 (Step 603). In an alternate embodiment, inputs to the mobile device 141 can be made by the user via gesture movements detect by the rotation sensor 133. For example, one rotation=input A; two rotations=input B; three rotations=input C, etc. In another embodiment, registration of the dose reminder device 100 with the host server 143 may be accomplished over Bluetooth. For example, the mobile device may broadcast a Bluetooth signal that is received by the Bluetooth transceiver 137 of the dose reminder device 100. Next, once the interaction button 105 on the dose reminder device 100 is pressed (can also be done by rotating the device upside down to eliminate the use of the physical interaction button 105) the dose reminder device 100 begins a Bluetooth pairing process with the mobile device. Once Bluetooth pairing is completed, the dose reminder device 100 is paired to the user's mobile device and also automatically registered with reminder device host server 143.

Figure 7:
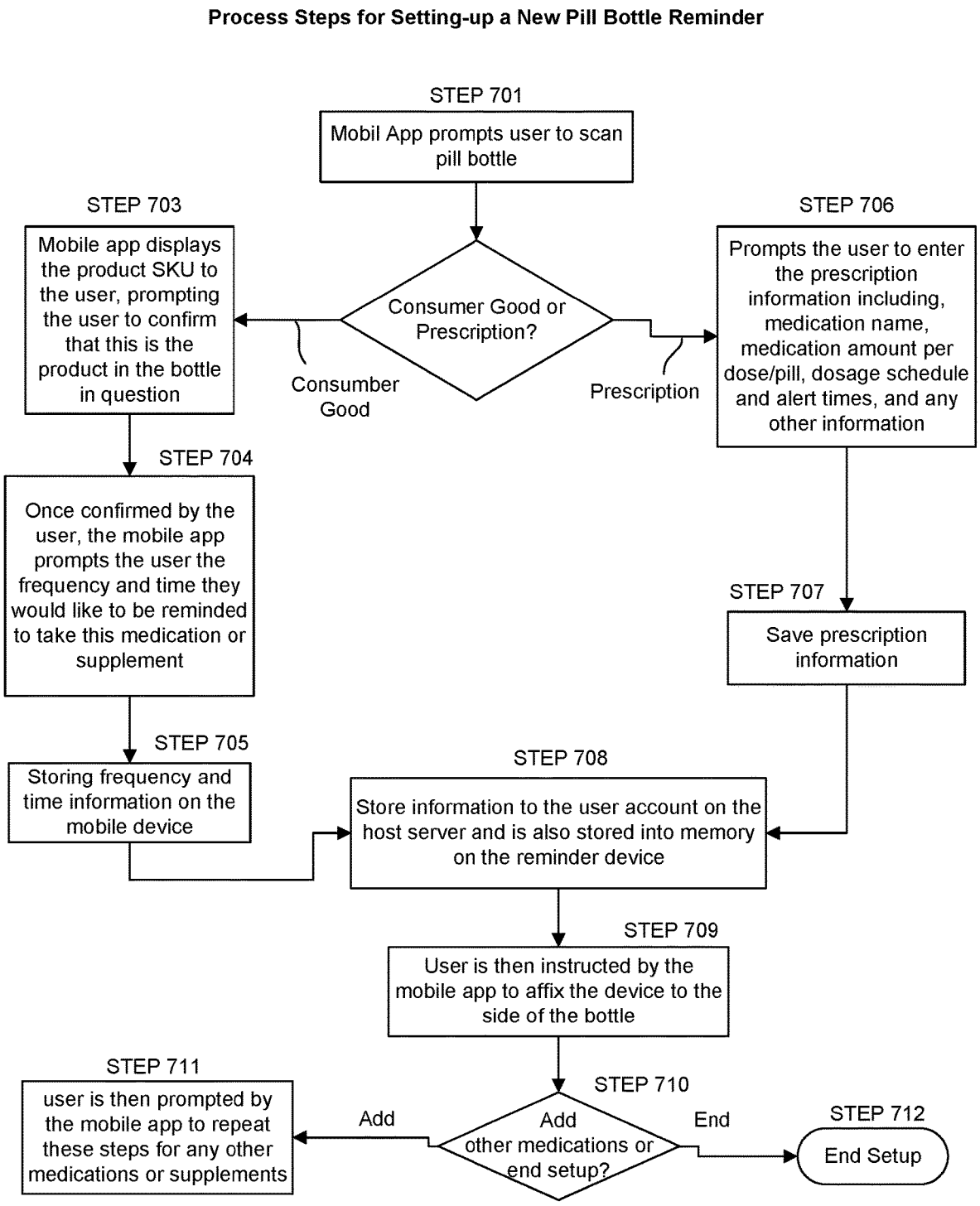
FIG. 7 illustrates a flowchart for setting up a new pill bottle reminder associated with the dose reminder device, in accordance to an embodiment.

FIG. 7 illustrates a flowchart for setting up a new pill bottle reminder associated with the dose reminder device 100, in accordance to an embodiment. To set up a new pill bottle with the dose reminder device 100, the mobile app 151 prompts the user to scan identification information (e.g., a bar code or QR code) on the pill bottle (Step 701). The identification information can also be entered manually into the mobile app 151. The mobile app 151 may provide the user images or visual examples on the display screen of where the barcodes might be based on different kinds of bottles to help the user find the identification information on the bottle. The identification information can either reveal that the bottle is a consumer-packaged good or a prescription number (Step 702). If the identification information reveals that the product is consumer-packaged goods, e.g., vitamins or over-the-counter supplements, then the mobile app 151 displays the product SKU to the user, prompting the user to confirm that this is the product in the bottle in question (Step 703). Once confirmed by the user, the mobile app 151 prompts the user the frequency and time they would like to be reminded to take this medication or supplement (Step 704). The frequency and time information is then saved (Step 705) and then stored to the user account on the host server 143, stored in the mobile app 151, and is also stored into system memory 123 inside the dose reminder device 100 (Step 708). If, alternatively, the identification information reveals that the product is a medical prescription, having a fill date and refill frequency (known by format of the number), then the mobile app 151 stores this fill and refill information and prompts the user to enter the prescription information including, medication name, medication amount per dose/pill, dosage schedule and alert times, and any other information (Step 706). The prescription information is then saved (Step 707) and then stored to the user account on the host server 143, stored in the mobile app 151, and is also stored into system memory 123 inside the dose reminder device 100 (Step 708). If possible, this prescription information can be gleaned automatically through partnerships with pharmacies having access to the user's medical and prescription information provided by their care provider. The information can alternatively be entered manually by the user.

The user is then instructed by the mobile app 151 to affix the dose reminder device 100 to the side of the bottle (Step 709). In addition, the mobile app 151 may display helpful information and instructions for this step showing visual images of how to properly attach and secure the dose reminder device 100 to the bottle. Finally, the user is then prompted by the mobile app 151 to repeat these steps for any other medications or supplements or can choose to end the setup process now (Steps 710-712).

Referring again to FIG. 1C and FIG. 1D, the bottle depressible button or sensor 110 can be provided on the back of the device to sense when a new bottle has been attached to the dose reminder device 100, in accordance to an embodiment. When the button or sensor 110 is activated, a new bottle activation signal from the dose reminder device 100 is transmitted to the mobile app 151 which displays a prompt on the mobile app 151 requesting information regarding the new bottle, for example. The mobile app 151 has a set of operational settings and/or capabilities associated with the dose reminder device 100 including, but not limited to:

- user notification setting that the dose reminder device 100 will flash the reminder light and make audio alerts based on the schedule they just entered
- alert light on/off setting on the dose reminder device 100
- alert audio on/off/ramping setting (ramping increasing volume over time)
- new device setting, including setting up and adding a new dose reminder device 100
- edit account information setting
- managing service subscription setting
- entering payment information setting
- canceling a subscription service setting
- checking subscription entitlement setting Additional features of the mobile app 151 can include:

- volume control setting to the audio setting line in the mobile app 151.
- firmware updates settings including tracking and managing device (and does a check and update during the initial device setup)
- volume and alert association settings to the mobile device 143 not the service.
- "apply changes to all devices" settings option if the user has more than one dose reminder device 100 and wants all devices on the account to get the new settings.
- Providing a low battery alert in the form of a flashing light and/or play a "low battery" sound and/or voice recording.

The mobile device 151 can send notifications to the user via email, push notifications or text messaging of the following types including, but not limited to:

- missed dose
- low battery
- system messages
- subscription status notifications
- new offers and upgrades available from the service
- new app version available
- new firmware available and update A user can also assign a second user, such as a family member or friend, to receive notifications.

Figure 8:
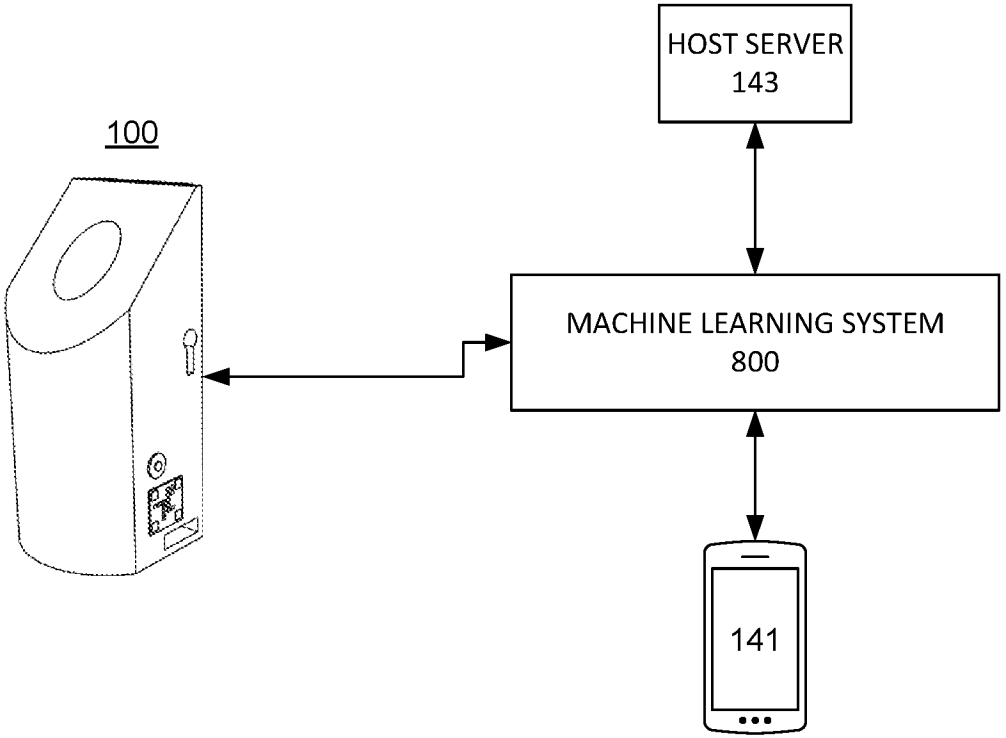
FIG. 8 illustrates a machine learning system for analyzing movement patterns associated with the dose reminder device, in accordance to an embodiment.

FIG. 8 illustrates a machine learning system 800 for analyzing movement patterns associated with the dose reminder device 100 via the rotation sensor 133, in accordance to an embodiment. The machine learning system 800 may interface with a server-side host (e.g., host server 141) or client-side device (e.g., mobile device 141) to analyze movement/motion data of the dose reminder device 100, learning how to filter out motions that are not associated with a user dispensing a pill. In this way, the machine learning system can filter out false positive motion and other motions that are not associated with the intended use of the device. For example, the machine learning system 800 can tell the difference between the user using the dose reminder device 100 for dispensing a pill (e.g., picking up the bottle, removing the top, tilting the bottle to pour a pill therefrom, replacing the top, and placing the bottle down) and other movements that may occur that do not involve dispensing a pill (e.g., accidentally knocking over the bottle, travel with the bottle, etc.). These movements not involved with dispensing a pill would be filtered out by the machine learning system 800 such that only movements associated with the intended use of the product would reset the alert.

Figure 9:
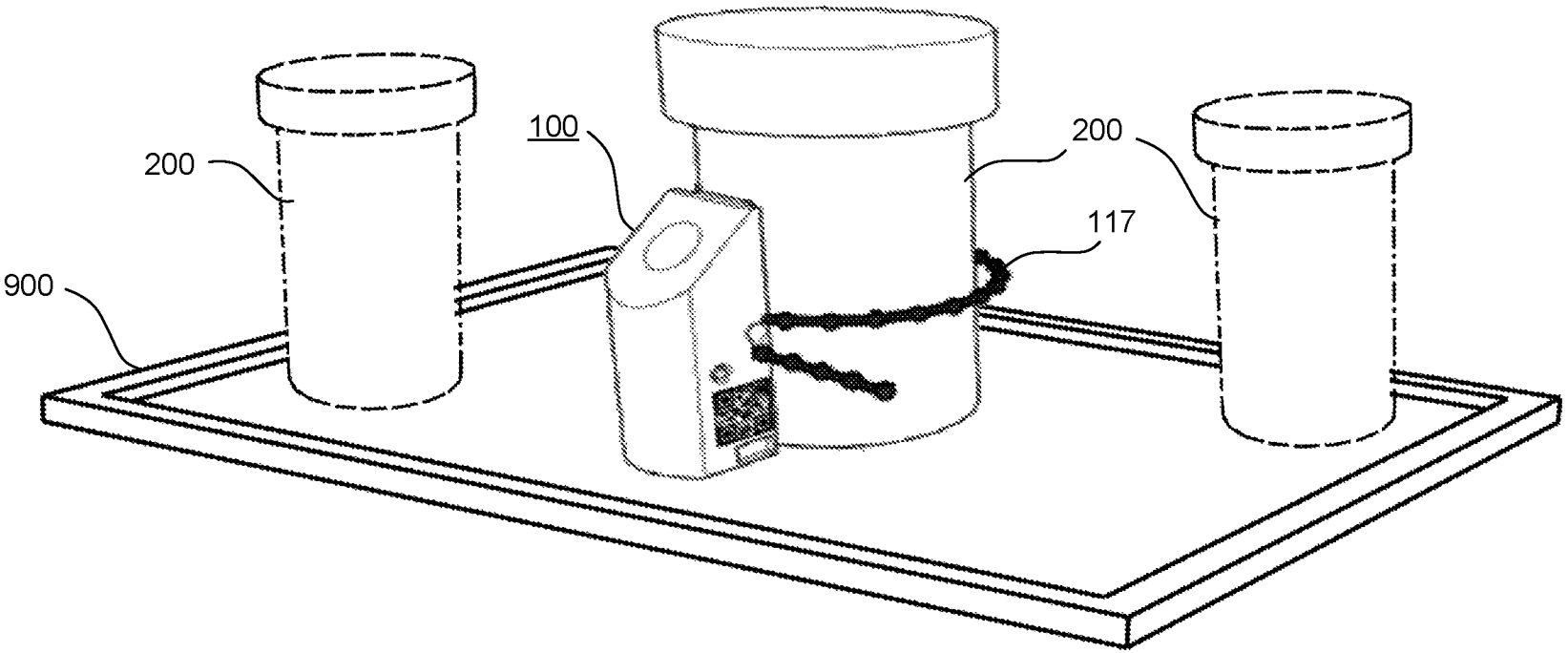
FIG. 9 illustrates a pill pad for use with the dose reminder device, in accordance to an embodiment.

FIG. 9 illustrates a pill pad 900 for use with the dose reminder device 100, in accordance to an embodiment. The dose reminder device 100 may interact with a "pill pad" 900 that can be used as simple as a tray on which the user places their pill bottles 200 to keep them in one place. The user can be instructed to keep pill bottles 200 with common use schedules in one common pill pad 900 so that one dose reminder device 100 can be used as a reminder for a common set of pills with a common dosage schedule. The user can then use a separate device (with a separate schedule) to remind the user of a common cadence for a separate tray of pills with a different dosage schedule. These trays can be color coded, contain built in charging (either wired or wireless inductive charging), and can include multiple packs of trays. In one example of using different color pill pads 900 (trays) with the dose reminder device 100, the user may have four medications, two are "once a day in the morning" and two are "three times a day". The user places the dose reminder device 100 on one of the "once a day in the morning" bottles, programs it and places it in a green tray with the other "once a day in the morning" bottle. Next, the user places the dose reminder device 100 on one of the "three times a day" bottles, programs it and places it in the blue tray with the other "three times a day" bottle. The user then needs only one dose reminder device 100 for each schedule rather than one for each bottle because the user knows to ingest the pills for the entire tray 900 when an alarm goes off for one bottle in that tray. In one implementation, the trays 900 can have a write-on label (pre-printed or otherwise) that indicates the schedule for the tray 900. In another implementation, the trays 900 can "click together" to make a larger try-unit with smaller sub-sections.

Figure 10A:
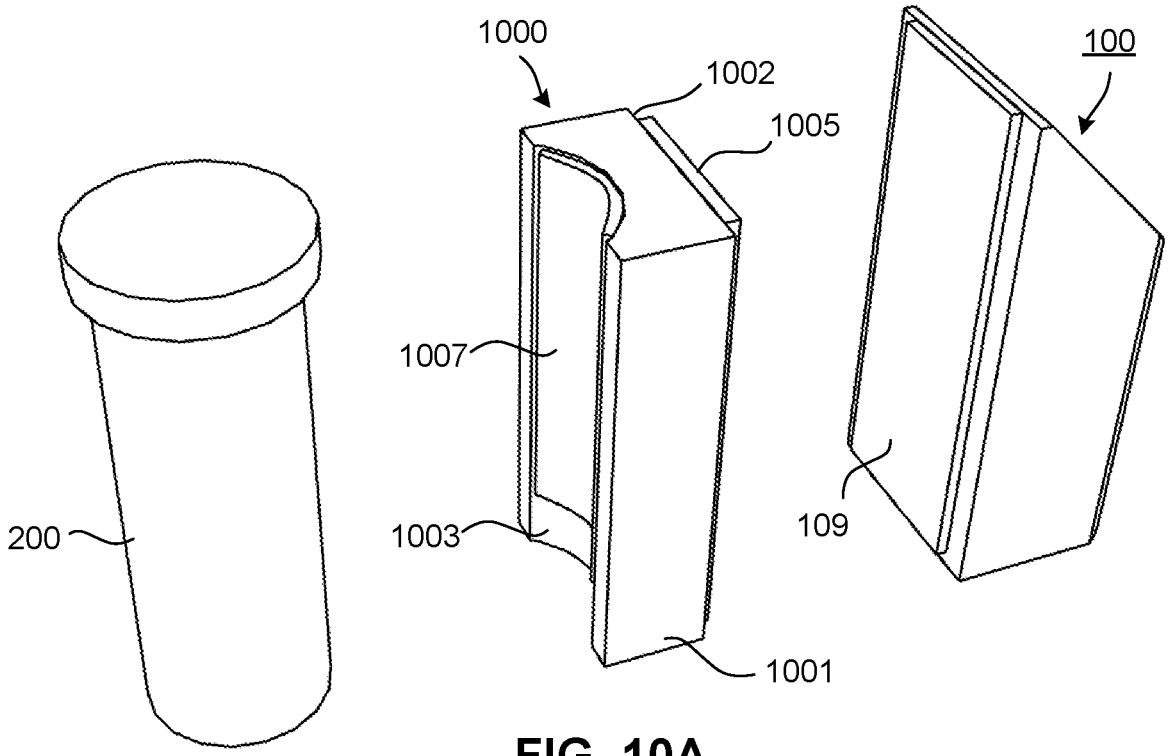
FIG. 10A-FIG. 10B illustrate a detachable fastener adapter for securing the dose reminder device to the bottle, in accordance to an embodiment.
Figure 10B:
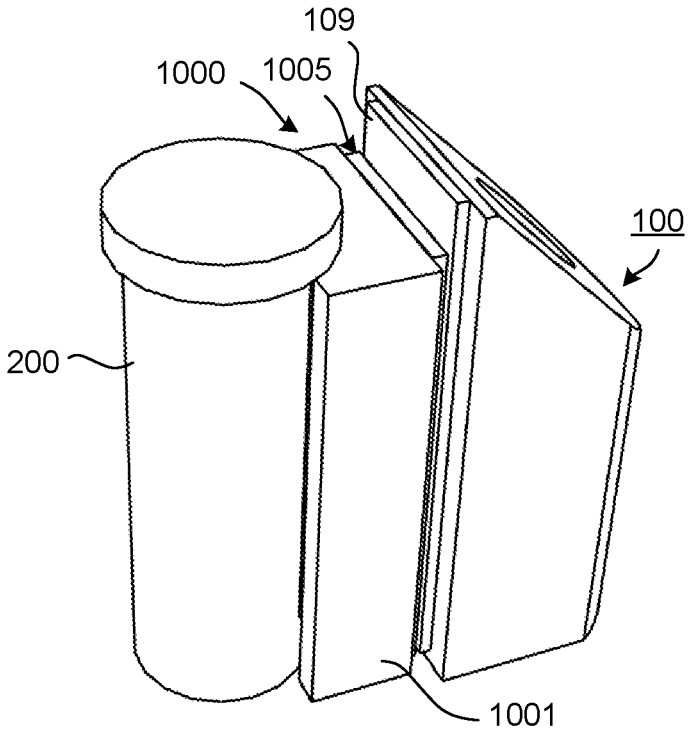

FIG. 10A-FIG. 10B illustrate a detachable fastener adapter 1000 which may secure the dose reminder device 100 to the bottle 200, in accordance to an embodiment. As depicted in FIG. 10A, the detachable fastener adapter 1000 may include a generally rectangular block 1001 having a planar side 1002 and an inward curved side 1003 disposed on a second side 1003 of the rectangular block 1001, opposing the planar side 1002. The size of the rectangular block is generally similar in size to the dose reminder device 100 in terms of height and width. In addition, the detachable fastener adapter 1000 may include a detachable fastener 1005 applied to the planar side 1002 and a permanent fastener 1007 applied to the inward curve side 1003. The inward curve side 1003 of the rectangular block 1001 is generally made to be complementary in shape to that of the outward curved shape of the cylindrical bottle 200, allowing the rectangular block 1001 to lie flushed against the cylindrical bottle 200 when coupled together, as shown in FIG. 10B. The backing strip 109 of the dose reminder device 100 may include a second detachable fastener, allowing the dose reminder device 100 and the detachable fastener adapter 1000 to connect via the detachable fastener 1005 and second detachable fastener, as shown in FIG. 10B, and separate from one another, as shown in FIG. 10A. Some examples of the detachable fastener 1005 and second detachable fastener may include hook-and-loop fasteners or magnetic fasteners of opposite polarities, while some examples of the permanent fastener 1007 may include adhesive films or liquid adhesives. In practice, the detachable fastener adapter 1000 coupling the dose reminder device 100 to the bottle 200 is generally bottle-agnostic, allowing it to be attached to practically any bottle having a cylindrically shaped body.

In sum, some advantages of the dose reminder device 100 include 1) the strap 117 attaching the dose reminder device 100 to the bottle is bottle-agnostic in regards to the shape and/or size of the bottle 200, allowing it to be secured to any types of bottles; 2) the dose reminder device 100 may be configured to detect any internal rotation or movement of the pill bottle 200 when attached to the dose reminder device 100 via the rotation sensor 133; 3) the user may cancel a given dose alarm event via the rotation sensor 133 of the dose reminder device 100 by rotating, tilting, or moving the attached pill bottle 200; 4) the rotation sensor 133 can detect and feedback to the microprocessor 121 whether the user only picks up the pill bottle 200, rotates it and places it back down the counter to cancel any given dose alarm event; 5) a reminder light 103 of the dose reminder device 100 flashes on-and-off to remind the user to take their medicine during a dose alarm event; and 6) an audio alarm controlled by the audio driver and speaker 129 in the dose reminder device 100 audibly alerts and reminds the user to take his/her medicine.

As these and other variations and combinations of the features discussed above can be utilized without departing from the disclosure as defined by the claims, the foregoing description of exemplary embodiments should be taken by way of illustration rather than by way of limitation of the disclosure as defined by the claims. It will also be understood that the provision of examples of the disclosure (as well as clauses phrased as "such as," "e.g.", "including" and the like) should not be interpreted as limiting the disclosure to the specific examples; rather, the examples are intended to illustrate only some of many possible aspects.

What is claimed is:

1. A dose reminder device comprising:

a main body;

a bottle-agnostic strap affixed to said main body, wherein said bottle-agnostic strap encompasses a medication bottle, wherein said bottle-agnostic strap is adjustable, allowing said bottle-agnostic strap to accommodate and secure to the medication bottle of any shape or size; and a plurality of electrical components housed within said main body for executing dose reminder programming codes and operating said dose reminder device, wherein said plurality of electrical components include at least a rotation sensor for detecting movement of said dose reminder device, wherein said dose reminder device is registered and connected to a host server over a network via a programming application interface operating on a mobile device or a computer-based device, wherein a new pill bottle reminder having an identification information is associated with said dose reminder device by 1) entering said identification information to said dose reminder device; 2) entering frequency and time interval information into said dose reminder device; 3) saving said frequency and time interval information to said dose reminder device; 4) storing said frequency and time interval information on said reminder device host server and a memory component of said reminder device; and 5) affixing said reminder device to a side portion of said pill bottle via said bottle-agnostic strap.

2. The dose reminder device of claim 1, wherein said dose reminder device is registered and connected to a host server over a network via a programming application interface operating on a mobile device or a computer-based device.

3. The dose reminder device of claim 2, wherein said programming application interface is a browser client application operating in said computer-based device.

4. The dose reminder device of claim 2, wherein said programming application interface is a mobile app operating in said mobile device.

5. The dose reminder device of claim 1, wherein a depressible button or sensor is disposed on a back side of said dose reminder device to sense when a new pill bottle has been attached to said dose reminder device.

6. The dose reminder device of claim 1, wherein a machine learning system interfaces with said dose reminder device for analyzing movement patterns associated with said dose reminder device via said rotation sensor.

7. The dose reminder device of claim 6, wherein said machine learning system filters and removes motions that are not associated with a user dispensing a pill.

8. The dose reminder device of claim 1, wherein a pill pad interacts with said dose reminder device for keeping one or more medication bottles in one place.

9. The dose reminder device of claim 8, wherein said pill pad includes a write-on label that indicates a schedule for said pill pad.

10. A dose reminder device comprising:

a main body;

a bottle-agnostic strap affixed to said main body, wherein said bottle-agnostic strap encompasses a medication bottle, wherein said bottle-agnostic strap is adjustable, allowing said bottle-agnostic strap to accommodate and secure to the medication bottle of any shape or size; and a plurality of electrical components housed within said main body for executing dose reminder programming codes and operating said dose reminder device, wherein said plurality of electrical components include at least a rotation sensor for detecting movement of said dose reminder device;

wherein said dose reminder device is registered and connected to a host server over a network via a programming application interface operating on a mobile device or a computer-based device, wherein said programming application interface operating on a mobile device or a computer-based device includes a set of operational settings associated with said dose reminder device, wherein said set of operational settings includes user a notification setting that said dose reminder device will flash a reminder light and make audio alerts based on a predetermined schedule, an alert light on/off setting on said dose reminder device, an alert audio setting, set-up and an add a new device setting, an editing account information setting, a managing a subscription service setting, an entering payment information setting, a canceling said subscription service setting, and a checking a subscription entitlement setting.

11. The dose reminder device of claim 10, wherein said set of operational settings further includes a volume control setting to an audio setting line in said mobile app, a firmware updates setting, volume and an alert association setting to said mobile device, an apply-changes-to-all-devices setting, and a low battery alert setting in the form of a flashing light and/or audio sound.

12. A dose reminder device comprising:

a main body;

a bottle-agnostic strap affixed to said main body, wherein said bottle-agnostic strap encompasses a medication bottle, wherein said bottle-agnostic strap is adjustable, allowing said bottle-agnostic strap to accommodate and secure to the medication bottle of any shape or size; and a plurality of electrical components housed within said main body for executing dose reminder programming codes and operating said dose reminder device, wherein said plurality of electrical components include at least a rotation sensor for detecting movement of said dose reminder device, wherein said dose reminder device is registered and connected to a host server over a network via a programming application interface operating on a mobile device or a computer-based device, wherein said dose reminder device sends one or more notifications to a user or a second user designated by the user via email, push notifications, or text messaging, including a missed dose message, a low battery message, system messages, subscription status notifications, new offers and upgrade messages from a subscription service, new app versions notifications, and new firmware updates notifications.

* * * * *